US009709016B2

(12) United States Patent
Reuther et al.

(10) Patent No.: US 9,709,016 B2
(45) Date of Patent: Jul. 18, 2017

(54) METHOD FOR OPERATING AN IGNITION DEVICE FOR AN INTERNAL COMBUSTION ENGINE

(71) Applicant: CONTINENTAL AUTOMOTIVE GMBH, Hannover (DE)

(72) Inventors: Achim Reuther, Donaustauf (DE); Harald Schmauss, Donaustauf (DE); Sven-Michael Eisen, Regensburg (DE); Martin Goetzenberger, Ingolstadt (DE)

(73) Assignee: Continental Automotive GmbH, Hannover (DE)

( * ) Notice: Subject to any disclaimer, the term of this patent is extended or adjusted under 35 U.S.C. 154(b) by 273 days.

(21) Appl. No.: 14/369,368

(22) PCT Filed: Dec. 17, 2012

(86) PCT No.: PCT/EP2012/075843
§ 371 (c)(1),
(2) Date: Jun. 27, 2014

(87) PCT Pub. No.: WO2013/098112
PCT Pub. Date: Jul. 4, 2013

(65) Prior Publication Data

US 2015/0008838 A1 Jan. 8, 2015

(30) Foreign Application Priority Data

Dec. 27, 2011 (DE) ..... 10 2011 089 966

(51) Int. Cl.
*F02P 3/04* (2006.01)
*F02P 3/02* (2006.01)
(Continued)

(52) U.S. Cl.
CPC ..... *F02P 3/0442* (2013.01); *F02P 3/02* (2013.01); *F02P 3/0407* (2013.01);
(Continued)

(58) Field of Classification Search
CPC F02P 3/0407; F02P 3/0435; F02P 3/02; F02P 3/0442; F02P 17/12; F02P 2017/121; F02D 2041/2003; F02D 2041/2051
(Continued)

(56) References Cited

U.S. PATENT DOCUMENTS 6,505,605 B2 * 1/2003 Yamada ..... F02P 17/12 123/406.12
6,512,375 B1 * 1/2003 Yamada ..... F02P 17/12 324/384

(Continued)

FOREIGN PATENT DOCUMENTS

DE 102004056844 A1 6/2006
DE 102007034390 A1 1/2009

(Continued)

*Primary Examiner* — Erick Solis
*Assistant Examiner* — Robert Werner
(74) *Attorney, Agent, or Firm* — Laurence A. Greenberg; Werner H. Stemer; Ralph E. Locher

(57) ABSTRACT

An ignition device for an internal combustion engine has an ignition coil disposed as a transformer, a spark plug connected to the secondary winding of the ignition coil, an actuatable switching element connected in series with the primary winding of the ignition coil, and a control unit connected to the primary winding and to the control input of the switching element. After charging the ignition coil, building up an ignition spark through non-conductive switching of the switching element, and after renewed conductive switching of the switching element for operating the ignition coil in transformer operation, the supply voltage of the control unit is detected and if a pre-determined value, representing the presence of a surface gap, is exceeded, the switching element is once more switched non-conductive.

4 Claims, 2 Drawing Sheets

(51) Int. Cl.

| | |
|---|---|
| ***F02P 15/10*** | (2006.01) |
| *F02P 17/12* | (2006.01) |
| *F02D 41/20* | (2006.01) |

(52) U.S. Cl.
CPC ..... *F02P 3/0435* (2013.01); *F02P 15/10* (2013.01); *F02P 17/12* (2013.01); *F02D 2041/2003* (2013.01); *F02D 2041/2051* (2013.01); *F02P 2017/121* (2013.01)

(58) Field of Classification Search
USPC ..... 123/621, 623, 650–652
See application file for complete search history.

(56) References Cited

U.S. PATENT DOCUMENTS

| | | | | |
|---|---|---|---|---|
| 6,842,007 | B2 * | 1/2005 | Butler, Jr. ..... | F02P 3/051 324/378 |
| 6,953,032 | B2 | 10/2005 | Goede | |
| 7,644,707 | B2 | 1/2010 | Kraus | |
| 8,985,090 | B2 * | 3/2015 | Bolz ..... | F02P 15/10 123/618 |
| 9,255,563 | B2 * | 2/2016 | Eisen ..... | F02P 3/053 |
| 2008/0121214 | A1 | 5/2008 | Bertsch | |
| 2012/0312285 | A1 * | 12/2012 | Bolz ..... | F02P 15/10 123/623 |
| 2013/0263835 | A1 * | 10/2013 | Eisen ..... | F02P 3/0435 123/623 |

FOREIGN PATENT DOCUMENTS

| | | | |
|---|---|---|---|
| DE | 102007034399 | A1 | 1/2009 |
| DE | 102009046397 | A1 | 5/2010 |
| DE | 102009057925 | A1 | 6/2011 |
| EP | 1854997 | A2 | 11/2007 |
| JP | 2010112209 | A | 5/2010 |
| WO | 2009012835 | A1 | 1/2009 |
| WO | 2009012836 | A1 | 1/2009 |
| WO | 2011070089 | A1 | 6/2011 |

* cited by examiner

METHOD FOR OPERATING AN IGNITION DEVICE FOR AN INTERNAL COMBUSTION ENGINE

BACKGROUND OF THE INVENTION

Field of the Invention

Series ignition systems in modern internal combustion engines in the form of Otto engines have for many decades operated on the basis of the simple and reliable principle of coil discharge, i.e. an ignition coil configured as a transformer is charged on the primary side corresponding to its inductance from the vehicle electrical distribution system voltage sometimes up to its saturation range. At the ignition time, the charge is interrupted by means of an electronic circuit, for example by means of an ignition IGBT (Insulated-Gate Bipolar Transistor). On the secondary side, a voltage of, for example, 5 kV to 35 kV is built up as a result, and this voltage results in a flashover in the combustion chamber of the internal combustion engine in the spark gap of the spark plug. Then, the energy stored in the coil is allowed to decay in the ignition plasma.

Each individual spark discharge is preceded in this case by various predischarges, which ultimately result in a voltage increase up to spark breakdown. Although this voltage increase occurs at approximately 1 kV/μs, it is not possible to avoid free charge carriers from accumulating in the surrounding medium on the ceramics of the spark plug which insulates the ignition electrodes and thus reducing the insulation resistance. In the case of modern highly charged Otto engines, increasing combustion chamber pressures result, inter alia, in an increase in the breakdown voltages which remains controllable only as a result of a solid insulation in all operating ranges. A weakening of the insulation effect of the ceramic insulators in this case typically results in formation of creeping sparks, wherein the spark does not form, as is conventional, between the ground electrode and the central electrode, but, creeping closely along the surface of the ceramic, seeks the connection to ground at the base of the ceramic. This type of spark discharge is fatal in combustion engineering since the heat transfer from the spark to the surrounding medium is drastically reduced and there is a considerable risk of a delayed combustion or even of a combustion dropout.

The possibilities for avoiding surface discharges at high combustion chamber pressures are very limited at present, and targeted avoidance is impossible. In general, care needs to be taken to ensure that, during engine operation, the ceramic surfaces are kept free from contamination of any type such as carbon black and liquid fuel. Even the quality of the surface structure of the ceramic and the structural configuration of the spark plug are of considerable importance. A surface discharge formation can only be actively prevented by reducing the breakdown voltage, i.e. decreasing the distance between the electrodes, and by reducing the combustion chamber pressure at the ignition time.

DE 10 2009 057 925.7, which is an application without prior publication, describes an innovative method for operating an ignition device for an internal combustion engine and an innovative ignition device for an internal combustion engine for implementing the method. According to said document, an ignition device for an internal combustion engine is formed with an ignition coil in the form of a transformer, a spark plug connected to the secondary winding of the ignition coil, a drivable switching element, which is connected in series with the primary winding of the ignition coil, and a control unit, which is connected to the primary winding of the ignition coil and the control input of the switching element. The control unit provides an adjustable supply voltage for the ignition coil and a drive signal for the switching element depending on the currents through the primary and secondary windings of the ignition coil and on the voltage between the node between the primary winding of the ignition coil and the switching element and the negative connection of the supply voltage. The method for operating this device has the following procedure:

in a first phase (charging), the switching element is switched on by the drive signal at a first switch-on time and switched off again at the predetermined ignition time, in a subsequent second phase (breakdown), the primary voltage or a voltage derived therefrom is compared with a first threshold value and, in the event that the first threshold value is undershot by this voltage, the switching element is switched on again at a second switch-on time, in a subsequent third phase (arc), the supply voltage is regulated in such a way that the current through the secondary winding of the ignition coil approximately corresponds to a predetermined current and the current through the primary winding of the ignition coil is compared with a predetermined second threshold value and, in the event that the second threshold value is exceeded by this current, the switching element is switched off again at a first switch-off time, in a subsequent fourth phase (breakdown), the current through the secondary winding of the ignition coil is compared with a third threshold value and, in the event that the third threshold value is undershot by this current, the switching element is switched on again at a third switch-on time, then the third and the fourth phases are repeated, if appropriate, until a predetermined combustion duration is reached at a time at which the switching element is finally switched off.

A corresponding device is illustrated in FIG. 1, and the time characteristic of the respective voltages and currents is illustrated in FIG. 2.

During engine operation, when the ignition time is reached, a rapid voltage increase until the breakdown voltage is reached is advantageous to the extent that static charging of all surfaces, which ultimately increases the probability of a surface discharge formation, tends to be avoided (benchmark approximately 1 kV/μs). Unfortunately, higher breakdown voltages on average are therefore reached, which in turn increases the need for insulation and also upwardly limits the rate of voltage rise. Since the occurrence of a surface discharge also has a very stochastic component, there is a possibility of, in the case of prompt identification of a surface discharge, temporarily cutting off the current flow to said surface discharge, ensuring the decay of said surface discharge and seeking to achieve a renewed spark buildup. Of central importance here is the maintenance of reasonable action and reaction times, i.e. <100 μs.

BRIEF SUMMARY OF THE INVENTION

The object on which the invention is based therefore consists in the timely identification of the occurrence of a surface discharge.

The object is achieved by a method as claimed.

The method described in DE 10 2009 057 925.7 for operating an ignition device for an internal combustion engine appears to be very suitable for the implementation of rapid surface discharge identification since the secondary-side AC voltage, in conjunction with current regulation, enables a possible configuration of a corresponding electronic circuit. Thus, generally the surface discharge is characterized by a typical initial plasma strand length, i.e. the shortest distance between the central electrode and the insulator base as the minimum length which cannot be undershot. Since the voltage requirement for producing and maintaining a surface discharge is proportional to the plasma length, the initial arc voltage requirement can be used directly after breakdown as identification criterion for spark judgment. Specifically, the DC-to-DC converter of a device in accordance with DE 10 2009 057 925.7 in the transformer operating mode switches to high power directly after the start of sparking in the transformer phase in order to supply energy to the surface discharge in accordance with the transformation ratio of the coil. This high capacity utilization directly after the start of sparking can be assessed or evaluated in accordance with the invention directly as criterion of the presence of a surface discharge.

In advantageous developments of the invention, a current interruption up to decay of the spark can be provided. Possibly, it is possible to wait for a predetermined amount of time until renewed buildup of a spark in order to ensure a recombination of ions so that no new surface discharge is produced. The renewed buildup can, in one development of the invention, take place with reverse polarity, possibly also depending on the combustion chamber pressure.

The object is additionally achieved by an ignition device for an internal combustion engine as claimed. Advantageous developments are specified in the dependent claims.

The invention will be described in more detail below with reference to an exemplary embodiment with the aid of figures, in which

DESCRIPTION OF THE INVENTION

Figure 1:
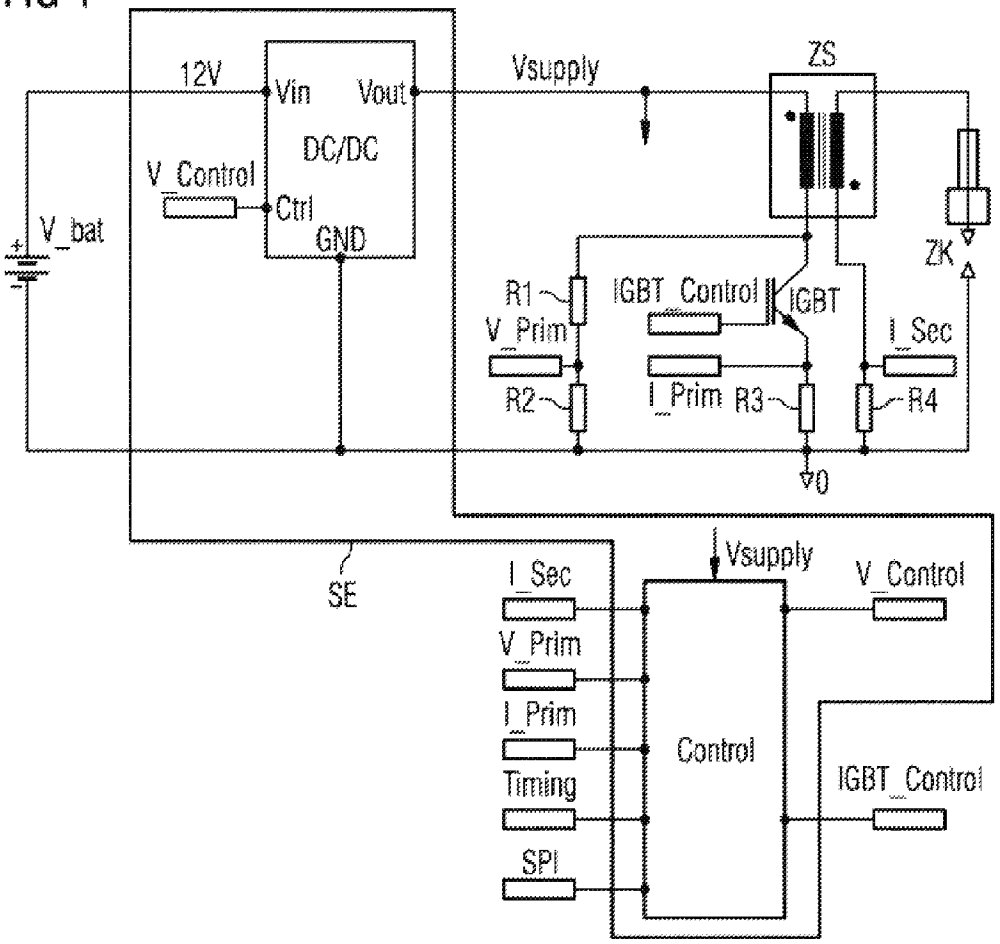
FIG. 1 shows a block circuit diagram of an ignition device on which the method according to the invention is based.

The ignition device according to the invention shown in FIG. 1 contains a controllable supply voltage source DC/DC in the form of a voltage converter for supplying a possibly variable supply voltage Vsupply to one or more ignition coils ZS. Said supply voltage source is supplied from the vehicle electrical distribution system voltage V_bat of approximately 12 V at present. It supplies one or more ignition coils ZS, wherein advantageously no blocking diode is required any more. Conventional spark plugs ZK can be used which are connected to the secondary winding of the ignition coil ZS. The primary winding of the ignition coil ZS is connected in series with a switching element, which is usually in the form of an IGBT, for switching the ignition coil ZS. Devices for detecting the primary voltage and the primary and secondary current are provided.

A control unit SE generates the variable supply voltage Vsupply and the drive signal IGBT_Control for the switching element IGBT by means of the voltage converter DC/DC depending on the detected operating variables.

The control unit SE is in turn controlled by a microcontroller (not illustrated), which predetermines the ignition time for each ignition coil via separate timing inputs in real time. Data can be interchanged between the microcontroller and the control unit SE via a further interface, for example the conventional SPI (Serial Peripheral Interface).

The voltage converter DC/DC generates a supply voltage Vsupply from the 12 V vehicle electrical distribution supply V_bat. This value for the supply voltage Vsupply is controllable by means of the control signal V_Control at the control input Ctrl of the voltage converter DC/DC in a range of, for example, 2 to 30 V in highly dynamic fashion. The voltage converter DC/DC can in this case provide the required charge current for the respective activated ignition coil ZS.

A conventional type with a transformation ratio of, for example, 1:80 can be used as the ignition coil ZS, but it is possible to dispense with the blocking diode required in ignition systems in customary use nowadays. Depending on the number of cylinders of the Otto engine used, 3 to 8 ignition coils are required, for example. However, owing to the method according to the invention, it is possible to use an ignition coil with a substantially lower maximum storage energy.

A conventional type can be used as spark plug ZK. Its precise configuration is determined by the use in the engine.

Likewise, a conventional type with an internal voltage limitation of, for example, 400 V can be used as switching element IGBT. Depending on the required charging current, its required current-carrying capacity can be reduced, however.

The signal V_Prim reproduces the primary voltage of the ignition coil ZS which is reduced by means of a voltage divider comprising resistors R1 and R2 from up to 400 V to a value range of, for example, 5 V which is usable for the control unit SE. The value of the voltage division in the cited example is 1:80. The voltage divider R1, R2 is arranged between the node between the primary winding of the ignition coil ZS and the switching element IGBT and the ground connection 0. The ground connection 0 is connected to the negative potential GND of the supply voltage Vsupply.

In order to measure the current through the primary winding of the ignition coil ZS, a resistor R3 is connected in series with the primary winding and the switching element IGBT. The charge current flowing through the resistor R3 generates a voltage I_Prim representing the current.

In the same way, a resistor R4 is connected in series with the secondary winding of the ignition coil ZS. The secondary current flowing through this resistor R4 generates the voltage drop I_Sec across the resistor R4.

The control unit SE comprises the voltage converter DC/DC and a control circuit Control. Said control unit detects the signals V_Prim, I_Prim and I_Sec and compares them with threshold values or setpoint values by means of voltage comparators.

At a time which is predetermined by the input signal Timing from the microcontroller, the control unit SE initiates an ignition process, wherein the arc duration and the arc current are regulated. For this purpose, the supply voltage Vsupply is controlled via the control signal V_Control or the switching element IGBT is switched on and off via the drive signal IGBT_Control. In the case of Otto engines comprising a plurality of cylinders, correspondingly more Timing inputs and more IGBT_Control outputs need to be provided.

Figure 2:
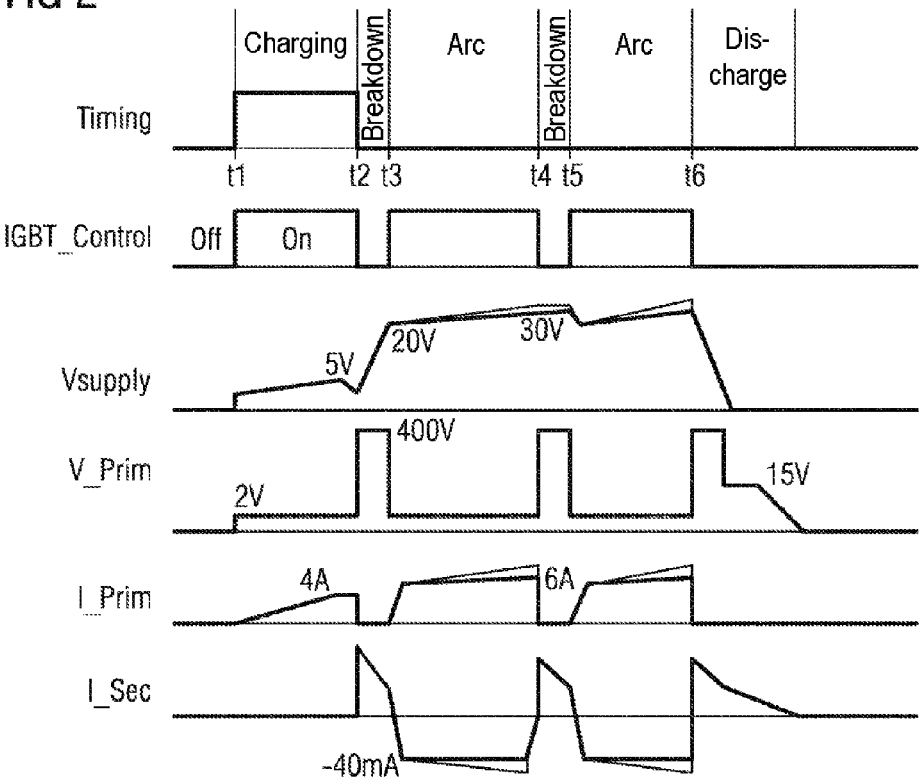
FIG. 2 shows a flow chart illustrating the temporal relationships.

The ignition device is in this case operated as follows and as illustrated in FIG. 2. The method in this case comprises a plurality of successive phases.

1. Charging of the Coil Inductance

At the beginning of the ignition, the magnetizing inductance of the ignition coil ZS is charged. For this, the switching element IGBT is switched on at time t1 via the drive signal IGBT_Control from the control unit SE. The charge current is in this case detected as signal I_Prim. Since no secondary-side blocking diode is used, the supply voltage Vsupply needs to be varied over time during the charging operation such that the voltage induced in the process on the secondary side safely remains below the instantaneous breakdown voltage. The value of this voltage is determined substantially by the instantaneous combustion chamber pressure, which varies continuously during the compression stroke. It is important here that the charge current value which corresponds to the desired storage energy is reached at the latest at ignition time t2. It is insignificant if the charge current value is reached slightly earlier since, as a result of a reduction of the supply voltage Vsupply, the current can be kept constant. The supply voltage Vsupply is in this case regulated to a value which is determined by the internal resistance of the primary winding and the charge current. In addition, the voltage losses at the switching element IGBT and at the current measuring resistor R3 are also taken into consideration. The value of the energy to be stored may be different, based on the observation of preceding ignition processes or predetermined via SPI, for each charging phase and may be adapted correspondingly.

2. Breakdown

At the predetermined ignition time t2, the switching element IGBT is switched off via the drive signal IGBT_Control. Driven by the collapse of the magnetic field, the primary and secondary voltages of the ignition coil ZS now increase rapidly.

The supply voltage Vsupply is, at the start of the breakdown phase, set quickly to its maximum of, for example, 30 V by means of the control signal V_Control, which cannot be seen in detail in FIG. 2.

3. Arc Phase (Arc)

The beginning of the arc phase is identified as soon as the primary voltage falls below a predetermined value of, for example, 40 V at time t3. The signal V_Prim derived therefrom by means of the voltage divider R1, R2 then has a value of, for example, 0.5 V and can be compared against a first threshold value by means of a first voltage comparator. The output of the first voltage comparator changes its logic state when the setpoint value is undershot. This change serves to switch on the switching element IGBT once again at time t3.

If at this time of operation of the ignition coil as a transformer there is a surface discharge, the energy requirement is much higher than in the case of a desired spark, with the result that the DC-to-DC converter DC/DC provides a high voltage Vsupply at its output, so that the power made available by it is approximately 80% to 90% of its maximum power. This high voltage is detected in a manner in accordance with the invention and, as a result, a surface discharge is identified in good time.

In an advantageous development of the invention, the current flow is thereupon interrupted by opening of the switch IGBT, so that the surface discharge is extinguished. After an optional wait time, the switch IGBT is switched on again, wherein renewed buildup of a spark can take place, possibly with reversed polarity, depending on the combustion chamber pressure, which can be calculated from the ignition angle, the degree of charging and the compression ratio and possibly further known variables. A critical combustion chamber pressure is approximately 15 bar. Below 15 bar, renewed buildup of a spark with a negative polarity is advantageously conducted, while above 15 bar the polarity is maintained.

If, after renewed ignition and the following transfer to the transformer operating mode, a surface discharge should be identified again, the above-described method according to the invention can be repeated. Otherwise, the procedure described at the outset is continued.

The invention claimed is:

1. A method of operating an ignition device for an internal combustion engine, the ignition device having an ignition coil formed as a transformer with a primary winding and a secondary winding, a spark plug connected to the secondary winding of the ignition coil, a drivable switching element connected in series with the primary winding of the ignition coil, and a control unit connected to the primary winding of the ignition coil and to a control input of the switching element, the method comprising:

providing with the control unit a supply voltage for the ignition coil and a drive signal for the switching element depending on a current through the primary winding and a current through the secondary winding of the ignition coil and on a primary voltage between a node connecting the primary winding of the ignition coil and the switching element and a negative connection of the supply voltage;

alternately switching-on and switching-off the switching element depending on whether threshold values for the primary voltage or a voltage derived therefrom are undershot or exceeded, to thereby transfer energy into an ignition spark of the spark plug through the current through the primary winding of the ignition coil and the current through the secondary winding of the ignition coil; and once the ignition coil has been charged, an ignition spark has been built up by switching-off the switching element and the switching element has been switched on once more for operating the ignition coil in a transformer operating mode, detecting the supply voltage of the control unit and, if a predetermined value of the supply voltage representing a presence of a surface discharge is exceeded, switching off the switching element.

2. The method according to claim 1, which comprises, after a wait time for a decay of charges at the ignition coil, once more starting the ignition procedure.

3. The method according to claim 2, which comprises starting the renewed ignition with reverse polarity of the supply voltage depending on a combustion chamber pressure.

4. The method according to claim 3, which comprises, in a case of a combustion chamber pressure of less than approximately 15 bar, causing the renewed ignition to take place with reverse polarity.

* * * * *